US006821371B1

(12) United States Patent
Liu

(10) Patent No.: US 6,821,371 B1
(45) Date of Patent: Nov. 23, 2004

(54) METHOD FOR APPLYING RIGID AND SELF-ADHESIVE PRINTED MATTER TO A CURVED SURFACE OF AN OBJECT

(76) Inventor: Kuo-Lung Liu, No. 9, Alley 19, Lane 235, Sec. 1 Chang Shui Rd., Hsiu Shui Hsiang, Chang Hua Hsien (TW)

( * ) Notice: Subject to any disclaimer, the term of this patent is extended or adjusted under 35 U.S.C. 154(b) by 135 days.

(21) Appl. No.: 10/244,840

(22) Filed: Sep. 17, 2002

(51) Int. Cl.[7] ..... G09F 3/10; B31F 1/00

(52) U.S. Cl. ..... 156/221; 156/278; 40/310

(58) Field of Search ..... 156/221, 278; 264/509; 40/310, 315, 331

(56) References Cited

U.S. PATENT DOCUMENTS 6,656,305 B1 * 12/2003 Nazikkol et al. ..... 156/221

* cited by examiner

*Primary Examiner*—Blaine Copenheaver
*Assistant Examiner*—Barbara J Musser

(57) ABSTRACT

A method is designed to apply a rigid and self-adhesive printed matter to a curved surface of the object. The method includes a first step in which the printed matter is provided with a coating of epoxy resin before the printed matter is baked. After the baking process, the printed matter is contoured to fit the curved surface of the object and is then cooled to take form. The printed matter is attached to the curved surface of the object by the self-adhesive side thereof.

1 Claim, 3 Drawing Sheets

METHOD FOR APPLYING RIGID AND SELF-ADHESIVE PRINTED MATTER TO A CURVED SURFACE OF AN OBJECT

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a rigid and self-adhesive printed matter applicable to the surface of an object, and more particularly to a method for applying the rigid and self-adhesive printed matter to the curved surface of an object.

BACKGROUND OF THE INVENTION

As illustrated in FIG. 3, a label 40 is attached to the curved surface of an object 30. The label 40 is provided with a soft layer 41 to facilitate the attaching of the label 40 to the curved surface of the object 30. In light of the slight elasticity of the soft layer 41, the label 40 is apt to become detached gradually from the curved surface of the object 30.

In order to prolong the longevity of the label 40, the label 40 may be provided with a rigid layer. Before applying the label 40 to the curved surface of the object, the rigid layer of the label 40 must be provided with a surface that is contoured to fit the curved surface of the object. Such a prior art method for applying the rigid and self-adhesive label to the curved surface of an object is inefficient at best. In addition, the label cannot be reused, once it is applied to the surface of the object. A more efficient method was devised such that the label is made of a plastic material by injection molding. However, the label is subjected to a high temperature of 180 degrees Celsius during the process. As a result, the label is apt to be damaged by heat or even become scorched.

BRIEF SUMMARY OF THE INVENTION

The primary objective of the present invention is to provide a method for applying a rigid and self-adhesive printed matter to the curved surface of an object. The method of the present invention overcomes the deficiencies of the prior art methods described above.

The method of the present invention involves a first step in which the rigid and self-adhesive printed matter is coated with epoxy resin. Such a coated printed matter is baked at a predetermined temperature and is then contoured by a molding device so as to fit the curved surface of an object to which the rigid and self-adhesive printed matter is to be attached. The contoured printed matter is cooled before the printed matter is attached to the curved surface of the object by the self-adhesive surface thereof.

The features and the advantages of the present invention will be more readily understood upon a thoughtful deliberation of the following detailed description of the present invention with reference to the accompanying drawings.

DETAILED DESCRIPTION OF THE INVENTION

Figure 1:
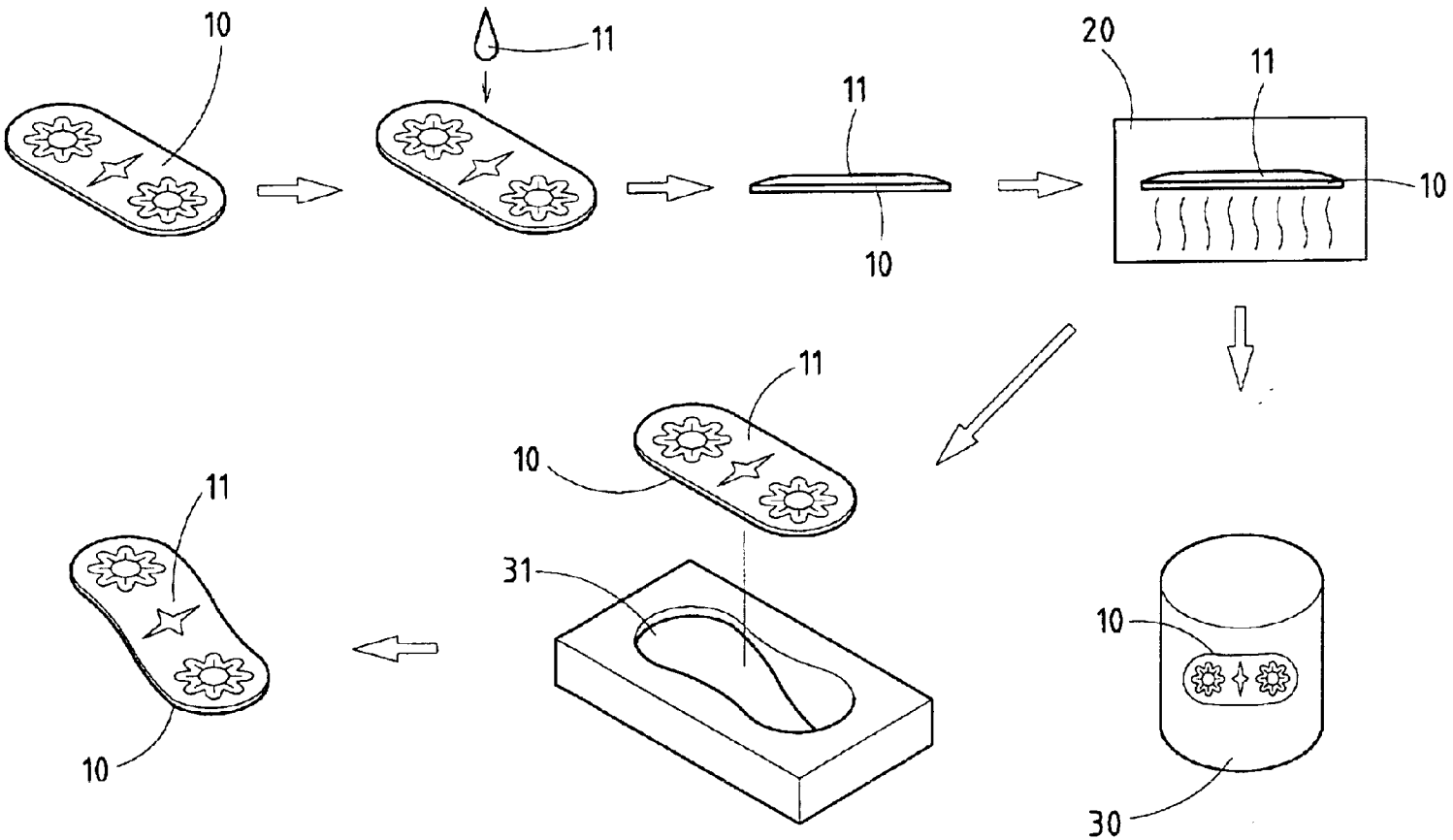
FIG. 1 shows a schematic diagram of the process flow of the present invention.
Figure 2:
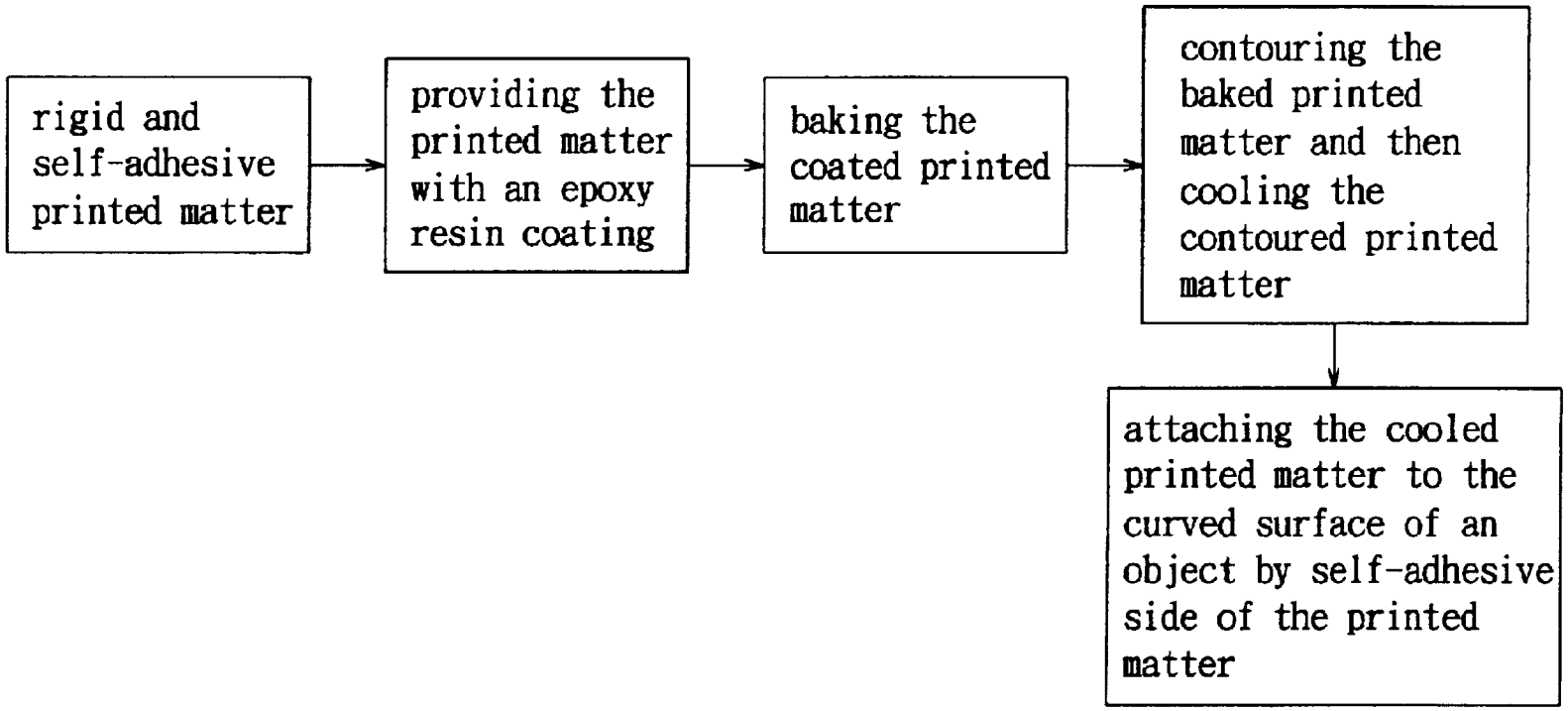
FIG. 2 shows a block diagram of the process flow of the present invention.
Figure 3:
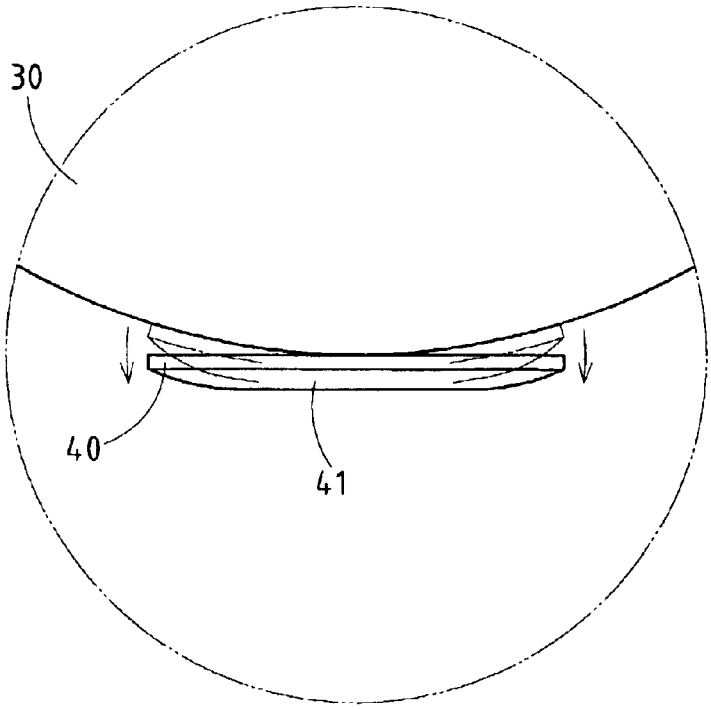
FIG. 3 PRIOR ART
FIG. 3 shows a schematic view of a prior art label being attached to the curved surface of an object.

As shown in FIGS. 1 and 2, a method embodied in the present invention is designed to apply a rigid and self-adhesive printed matter 10 to the curved surface of an object 30. The printed matter 10 has graphics printed thereon. The underside of the printed matter 10 is provided with an adhesive coating.

The method of the present invention involves a first step in which the upper side of the rigid printed matter 10 is uniformly coated with epoxy resin 11 before the printed matter 10 is baked in an oven 20 at a temperature ranging from 50 to 150 degrees Celsius for about 30 minutes. Thereafter, the printed matter 10 is transferred to a molding device 31 by which the printed matter 10 is contoured to fit the curved surface of the object 30. Upon completion of the molding process, the printed matter 10 is cooled to take form. Finally, the printed matter 10 is attached securely to the curved surface of the object 30 by the self-adhesive underside of the printed matter 10.

The printed matter 10 can be peeled off from the curved surface of the object 30 and reused in such a manner that the printed matter 10 is applied to another curved surface different in contour from the curved surface of the object 30. However, the printed matter 10 must be reheated and shaped to conform to the contour of another curved surface.

The embodiment of the present invention described above is to be regarded in all respects as being illustrative and nonrestrictive. Accordingly, the present invention may be embodied in other specific forms without deviating from the spirit thereof. The present invention is therefore to be limited only by the scope of the following appended claim.

What is claimed is:

1. A method for applying a rigid and self-adhesive printed matter to a curved surface of an object, said method comprising the steps of:

providing a non-adhesive side of the rigid and self-adhesive printed matter with an epoxy resin coating;

baking said printed matter after being coated with epoxy-resin at a temperature ranging from 50 to 150 degrees Celsius for 30 minutes;

contouring said printed matter after baking to fit the curved surface of the object;

cooling said printed matter after contouring; and attaching said printed matter after cooling to the curved surface of the object by the self-adhesive side of the printed matter.

* * * * *